US005429360A

United States Patent [19]

Capecci, Jr.

[11] Patent Number: 5,429,360

[45] Date of Patent: Jul. 4, 1995

[54] STREET HOCKEY PUCK

[76] Inventor: Raymond E. Capecci, Jr., 78 Laconia Ave., Staten Island, N.Y. 10305

[21] Appl. No.: 209,708

[22] Filed: Mar. 14, 1994

[51] Int. Cl.[6] ..... A63B 71/04

[52] U.S. Cl. ..... 273/128 R

[58] Field of Search ..... 273/108, 126 R, 7, 128 R, 273/128 A, 128 CS, 336, 424; 63/3, 5.1, 5.2

[56] References Cited

U.S. PATENT DOCUMENTS

| | | | |
|---|---|---|---|
| 1,489,550 | 4/1924 | Shaffer | 273/128 R |
| 2,427,117 | 9/1947 | Barmache et al. | 63/3 |
| 2,452,286 | 10/1948 | Benjamin | 63/5.2 |
| 4,627,739 | 12/1986 | Shingo et al. | 63/5.1 X |
| 4,760,715 | 8/1988 | Ramos, Jr. | 63/3 X |
| 5,074,127 | 12/1991 | Yurman | 63/3 |

*Primary Examiner*—Raleigh W. Chiu

[57] ABSTRACT

Disclosed is a new street hockey puck for providing a playing and scoring medium for use on hard synthetic playing surfaces such as concrete, asphalt, and the like, during a game of street hockey. The puck has playing characteristics which simulate the response of a conventional puck during a game of ice hockey, particularly the characteristic of sliding flat rather than bouncing and rolling across the playing surface. The new street hockey puck is resistant to wear from the abrasive playing surfaces frequently employed for street hockey. The street hockey puck comprises a toroidal core formed of rigid steel surrounded by a helically wound outer sidewall structure of spring steel rod. The outer sidewall structure forms an impact surface having repeatable resilient characteristics whereby a skilled player may predictably manipulate the puck. The sidewall is essentially circular in cross section to prevent the puck from rolling on edge for further improved control.

1 Claim, 3 Drawing Sheets

PRIOR ART

STREET HOCKEY PUCK

BACKGROUND OF THE INVENTION

1. Field of the Invention

The present invention relates to hockey pucks and more particularly pertains to street hockey pucks which may be adapted for providing a playing and scoring medium for use on hard synthetic playing surfaces, such as concrete, asphalt, and the like, during a game of street hockey, the puck having playing characteristics which simulate the response of a conventional puck during a game of ice hockey, particularly the characteristic of sliding flat rather than bouncing and rolling across the playing surface, the street hockey puck additionally being resistant to wear from the abrasive playing surfaces frequently employed for street hockey.

2. Description of the Prior Art

The use of hockey pucks is known in the prior art. More specifically, hockey pucks heretofore devised and utilized for the purpose of providing a disk used in a game of hockey as a scoring and playing medium are known to consist basically of familiar, expected and obvious structural configurations, notwithstanding the myriad of designs encompassed by the crowded prior art which have been developed for the fulfillment of countless objectives and requirements.

The present invention is directed to improving devices for providing a playing and scoring medium for use on hard synthetic playing surfaces, such as concrete, asphalt, and the like, during a game of street hockey in a manner which is safe, secure, economical and aesthetically pleasing.

For example, U.S. Pat. No. 4,754,973 to Kunick discloses a floor hockey puck formed of two separate materials, the first being harder, less compressible and more dense that the second so as to provide mass and strength to the puck. The second material is softer and more resilient than the first so as to provide the resilience necessary for the proper handle of the puck and also to reduce bodily harm on contact with players. The two separate materials may be arranged in layers through the body of the puck. The floor hockey puck disclosed has a cylindrical peripheral wall with relatively sharp circumferential edges which tend to promote rolling on the edge leading to unpredictable puck movement and difficulty of control.

The prior art also discloses an impact safety hockey puck as shown in U.S. Pat. No. 3,675,928 to Gentile which consists of a collapsible and resilient sidewall structure defining a cavity and air relief means provides the hockey stick contacting portion as well as, impact-shock absorbing means to protect other players or spectators. Such structure is joined by top and bottom walls means to provide durable wearing surfaces for all hard surfaces including ice, as well as, driveways, streets, sidewalks, playgrounds and the like. U.S. Pat. No. 4,078,801 to White, Sr. shows a road hockey puck provided with a generally cylindrical body of foam rubber or the like. Two smaller-diameter disks or end plates of guide material are secured coaxially therewith on respective opposite ends of the body. Both of the above mentioned patents disclose relatively complicated hockey pucks that may be economically unfeasible for the buying public because of high costs for tooling and/or assembly. Furthermore, embodiments of both of the disclosed pucks have non-durable impact surfaces leading to premature wear when used on the abrasive playing surfaces frequently employed for street hockey.

Another patent of general interest is U.S. Pat. No. Des. 323,369 to De Masi, Jr. et al. which shows a hockey puck.

In this respect, the street hockey puck according to the present invention substantially departs from the conventional concepts and designs of the prior art, and in so doing provides an apparatus primarily developed for the purpose of providing a playing and scoring medium for use on hard synthetic playing surfaces, such as concrete, asphalt, and the like, during a game of street hockey, the puck having playing characteristics which simulate the response of a conventional puck during a game of ice hockey, particularly the characteristic of sliding flat rather than bouncing and rolling across the playing surface, the street hockey puck additionally being resistant to wear from the abrasive playing surfaces frequently employed for street hockey.

Therefore, it can be appreciated that there exists a continuing need for new street hockey pucks which can be used for providing a playing and scoring medium for use on hard synthetic playing surfaces, such as concrete, asphalt, and the like, during a game of street hockey, the puck having playing characteristics which simulate the response of a conventional puck during a game of ice hockey. In this regard, the present invention substantially fulfills this need.

As illustrated by the background art, efforts are continuously being made in an attempt to develop devices for providing a disk used in a game of hockey as a scoring and playing medium. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of hockey pucks now present in the prior art, the present invention provides a new hockey puck construction wherein the same can be utilized for providing a playing and scoring medium for use on hard synthetic playing surfaces, such as concrete, asphalt, and the like, during a game of street hockey. As such, the general purpose of the present invention, which will be described subsequently in greater detail, is to provide a new street hockey puck apparatus and method which has all the advantages of the prior art hockey pucks and none of the disadvantages.

The invention is defined by the appended claims with the specific embodiment shown in the attached drawings. For the purpose of summarizing the invention, the invention may be incorporated into a new street hockey puck for providing a playing and scoring medium for use on hard synthetic playing surfaces, such as concrete or asphalt, during a game of street hockey. The puck has playing characteristics which simulate the response of a conventional puck during a game of ice hockey, particularly the characteristic of sliding flat rather than bouncing and rolling across the playing surface. The new street hockey puck is resistant to wear from the abrasive playing surfaces frequently employed for street hockey. The street hockey puck comprises a toroidal core formed of rigid steel whereby an essentially disk-shaped body having the general size and mass of a hockey puck is defined. An outer sidewall structure of a spring steel rod is helically wound around the core to form an impact surface having repeatable resilient characteristics whereby a skilled player may predictably manipulate the puck. The sidewall is essentially circular in cross section to prevent the puck from rolling on edge for further improved control.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a street hockey puck for use on hard synthetic playing surfaces, like concrete, asphalt, and the like, during a game of street hockey which has playing characteristics simulating the response of a conventional puck during a game of ice hockey, particularly the characteristic of sliding flat rather than bouncing and rolling across the playing surface.

It is another object of the present invention to provide a new street hockey puck which may be easily and efficiently manufactured and marketed.

It is a further object of the present invention to provide a new street hockey puck which is of a durable and reliable construction.

An even further object of the present invention is to provide a new street hockey puck which is susceptible of a low cost of manufacture with regard to both materials and labor, and which accordingly is then susceptible of low prices of sale to the consuming public, thereby making such street hockey pucks economically available to the buying public.

Still yet another object of the present invention is to provide a new street hockey puck which provides in the apparatuses and methods of the prior art some of the advantages thereof, while simultaneously overcoming some of the disadvantages normally associated therewith.

Still yet another object of the present invention is to provide a new street hockey puck that is resistant to wear from the abrasive playing surfaces frequently employed for street hockey.

Yet another object of the present invention is to provide a new street hockey puck that has a low coefficient of friction when sliding across surfaces commonly used for playing street hockey.

Even still another object of the present invention is to provide a new street hockey puck that has repeatable response to impact by a hockey stick and other objects whereby a skilled player may perform consistently.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
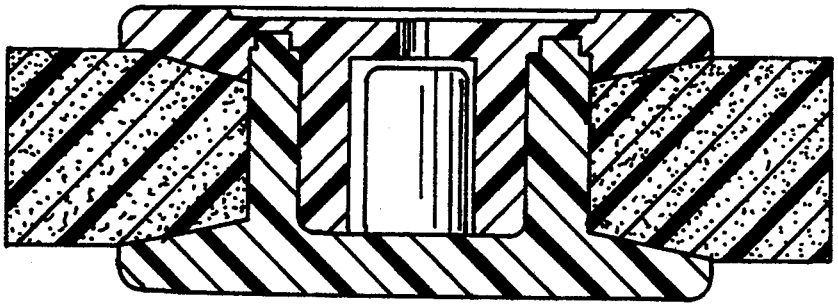
FIG. 1 is a sectional view of a prior art road hockey puck.
Figure 2:
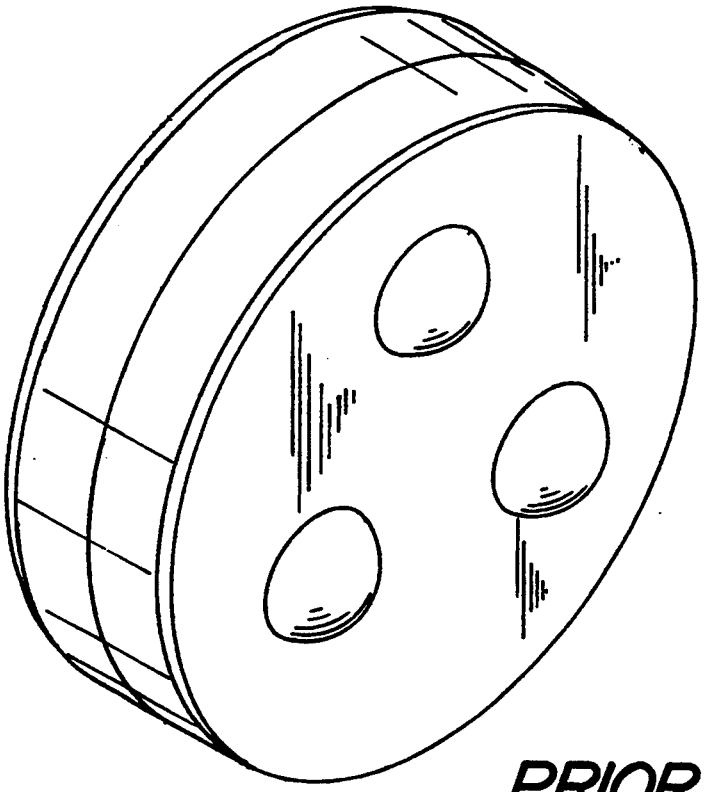
PRIOR ART Fig. 2
FIG. 2 is a perspective view of another prior art hockey puck.
Figure 3:
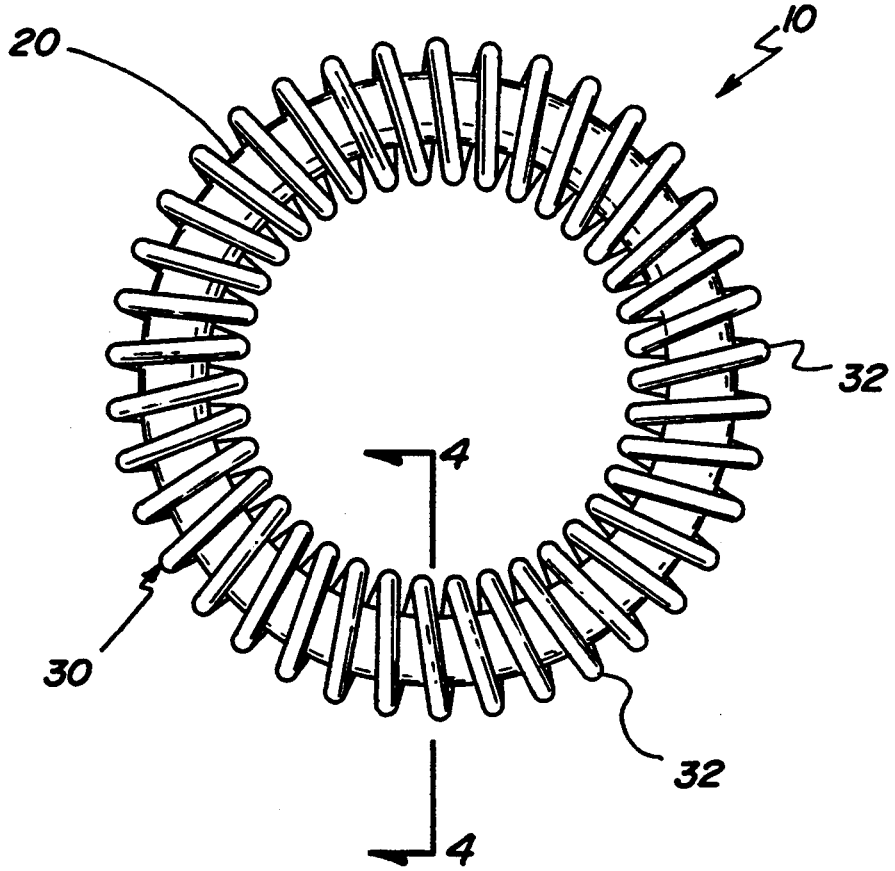
FIG. 3 is a top plan view of the new street hockey puck showing the toroidal core with surrounding helical impact structure.
Figure 4:
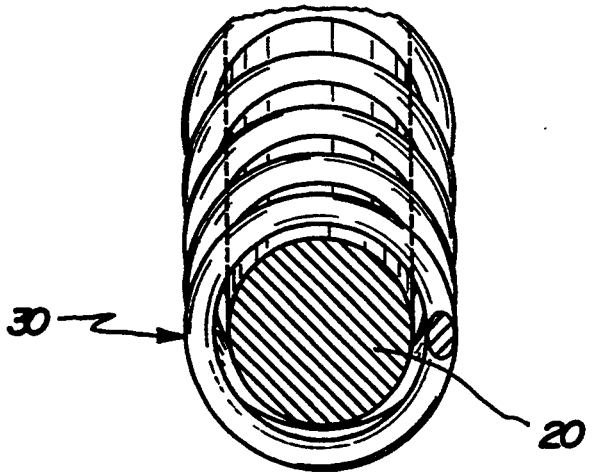
FIG. 4 is a sectional view of the invention of FIG. 3 taken along the line 4—4.
Figure 5:
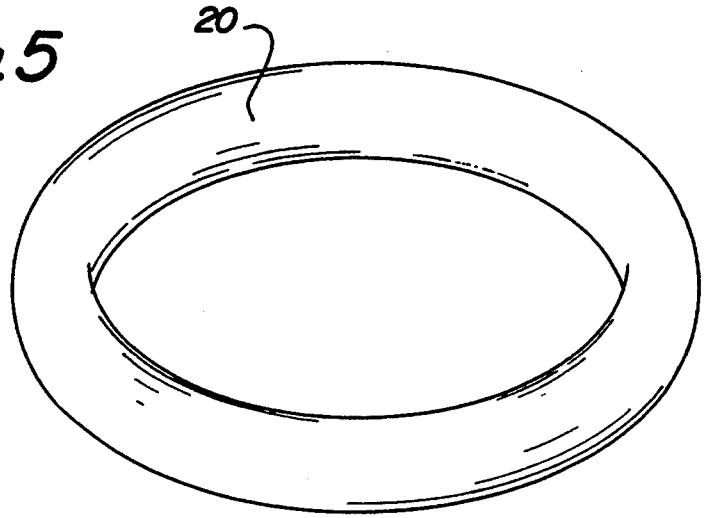
FIG. 5 is a perspective view of the toroidal core component of the present invention.
Figure 6:
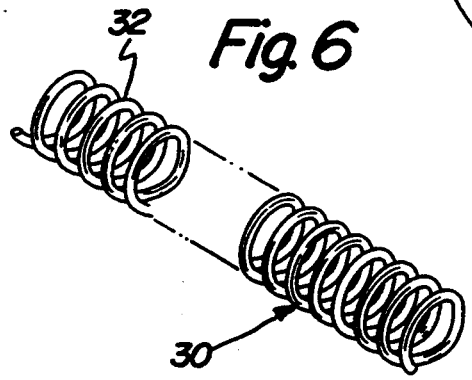
FIG. 6 is a perspective view of the helical impact structure component of the present invention.

With reference now to the drawings, and in particular to FIG. 3 thereof, a new street hockey puck embodying the principles and concepts of the present invention and generally designated by the reference numeral 10 will be described.

From an overview standpoint, the street hockey puck is adapted for use to provide a playing and scoring medium for use on hard synthetic playing surfaces, such as concrete, asphalt, and the like, during a game of street hockey. The puck has playing characteristics which simulate the response of a conventional puck during a game of ice hockey, particularly the characteristic of sliding flat rather than bouncing and rolling across the playing surface. The street hockey puck is resistant to wear from the abrasive playing surfaces frequently employed for street hockey. See FIG. 3.

Figure 7:
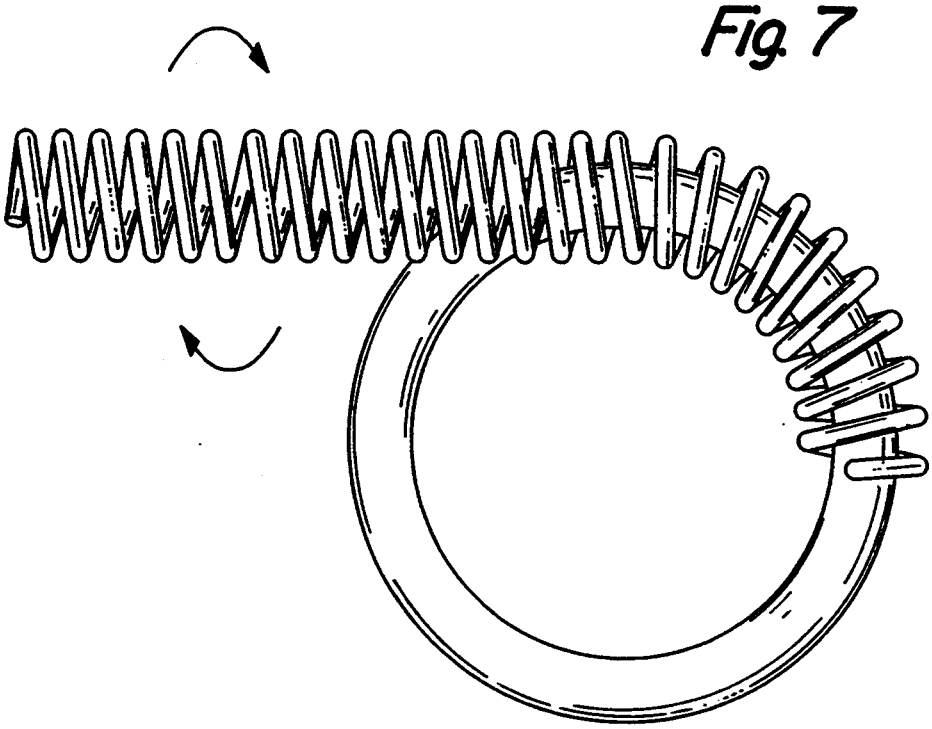
FIG. 7 is a top plan view of the new street hockey puck showing a method of construction.

With reference now to FIGS. 3–7 and more specifically, it will be noted that a new street hockey puck 10 for use on hard synthetic playing surfaces, such as concrete, asphalt, and the like, during a game of street hockey, is shown. The new street hockey puck 10 comprises a toroidal core 20 formed of rigid steel whereby a body having the general size and mass of a standard hockey puck is defined. An outer sidewall structure 30 of a spring steel rod 32 is helically wound around the core to form an impact surface having repeatable resilient characteristics whereby a skilled player may predictably manipulate the puck. The sidewall 30 is essentially circular in cross section to prevent the puck from rolling on edge for further improved control. FIG. 7 illustrates a method of construction wherein a predetermined length of the preformed helical sidewall structure 30 is twisted onto the toroidal core 20 until the core is completely encircled by the helical structure.

As to the manner of usage and operation of the present invention the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention. In as much as the present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A new street hockey puck for providing a playing and scoring medium for use on hard synthetic playing surfaces during a game of street hockey, the puck having playing characteristics which simulate the response of a standard puck during a game of ice hockey, particularly the characteristic of sliding flat rather than bouncing and rolling across the playing surface, the street hockey puck additionally being resistant to wear from the abrasive playing surfaces frequently employed for street hockey, the street hockey puck comprising:

a toroidal core formed entirely of rigid steel comprising a body to simulate a hockey puck, the toroidal core forming a closed loop; and an outer sidewall structure of a spring steel rod helically wound around the core to form a continuous and even impact surface entirely around the core having repeatable resilient characteristics whereby a skilled player may predictably manipulate the puck, the sidewall structure being essentially circular in cross section to prevent the puck from rolling on edge for further improved control.

* * * * *